United States Patent [19]

Ohkata

[11] Patent Number: 4,497,241

[45] Date of Patent: Feb. 5, 1985

[54] DEVICE FOR AUTOMATICALLY ADJUSTING ANGLE OF LOUVER

[75] Inventor: Ichizo Ohkata, Yokohama, Japan

[73] Assignee: Katou Hatsujo Kaisha Ltd., Yokohama, Japan

[21] Appl. No.: 603,752

[22] Filed: Apr. 25, 1984

[30] Foreign Application Priority Data

Dec. 7, 1983 [JP] Japan ..... 58-189105[U]

[51] Int. Cl.[3] ..... F24F 7/00

[52] U.S. Cl. ..... 98/40.25; 236/49

[58] Field of Search ..... 236/49, 101 R, 101 D, 236/101 E; 98/40 VT, 40 D

[56] References Cited

U.S. PATENT DOCUMENTS 3,068,776 12/1962 Day ..... 98/40 VT
3,811,369 5/1974 Ruegg ..... 98/40 D
4,227,646 10/1980 Hart et al. ..... 236/101 D

*Primary Examiner*—William E. Wayner

*Attorney, Agent, or Firm*—Schwartz, Jeffery, Schwaab, Mack, Blumenthal & Koch

[57] ABSTRACT

A louver is pivotally secured to a body in an air passage formed between side walls for altering the diffusing direction of diffused air. A device for changing the angle of the louver comprises a shape memory alloy spring for urging rotary force to the louver in one direction by fittings mounted at the side walls of the body and the louver, as required, and a bias spring for urging rotary force reverse to the louver in such a manner that the shape memory alloy spring and the bias spring are balanced in the air passage. The shape memory alloy spring is deformed by the bias spring when chilled air is fed to the passage to tiltably incline the louver. The shape memory alloy spring returns to a memorized position when warm air is fed to the passage to rotate the louver to a position aligned with the passage against the bias spring. Thus, the louver can be automatically controlled by sensing the temperature of the diffused air by the shape memory alloy spring and the bias spring. Since the manual adjusting work of the louver can be eliminated, much labor can be eliminated particularly in a large building.

8 Claims, 11 Drawing Figures

DEVICE FOR AUTOMATICALLY ADJUSTING ANGLE OF LOUVER

BACKGROUND OF THE INVENTION

This invention relates to a device for automatically adjusting the inclining angle of a louver for altering the direction of wind in louver equipment mounted on a ceiling or side wall of a room for directing hot or chilled air toward the desired direction and, more particularly, to a device for variably varying the angle of the louver in response to the variation in the temperature of diffused air at room cooling or heating time by utilizing a shape memory alloy and its characteristics.

A conventional device for altering the angle of louvers, which employs a shape memory alloy coil spring and a bias coil spring is known.

In this device, as shown in FIG. 1, louvers c, c, . . . which are respectively rotatable at pivot pins b, b, . . ., are pivotally aligned in parallel with each other at a diffuser frame a, a bias spring d and a shape memory alloy coil spring e are respectively provided at between the frame a and the free end of the upper end of the louver c as well as between the free end of the lower end of the louver c and the frame a in such a manner that the free ends of the louvers c, c, . . . are connected via fine wires f, f, . . . to each other. When the device is thus constructed, the spring e is cooled by cold air g at the room cooling time, thereby elongating the spring e, and the louvers c, c, . . . are inclined by the spring d upwardly as shown in FIG. 1. The spring e is, on the other hand, heated by hot air at the room heating time, thereby inclining the louvers c, c, . . . downwardly by overcoming the tension of the spring e. Thus, the louvers are automatically altered in the direction of diffused air from the diffuser.

However, in the above-described conventional device thus constructed, automating means cannot simply be mounted at the louvers which are manually operated to alter the direction of diffused air. Not only is this modification work complicated, but even new manufacture of this device takes a number of steps. Further, since the louvers c, c, . . . are connected via fine wires f, f. . . . in the conventional structure, trouble such as a disconnection feasibly occurs. In addition, the louvers of thin plates such as for an air conditioner can be readily altered in the direction of wind or air, but the louvers which are installed in a building have a large retension force, and the operation of the louvers is difficult in the conventional example of this type.

SUMMARY OF THE INVENTION

Accordingly, an object of this invention is to provide a device for automatically adjusting the angle of louvers which can eliminate the aforementioned drawbacks and in which fittings are attached in position, thereby arranging a shape memory alloy spring and a bias spring at predetermined positions for retaining a suitable relative relationship therebetween, thereby automatically altering the louvers so as not to diffuse chilled air directly to human bodies in cold season in summer, and eliminating manual labor by automatically controlling the direction of diffused air.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Embodiments of a device for automatically adjusting the angle of louvers constructed according to the present invention will now be described in more detail with reference to the accompanying drawings.

Figure 1:
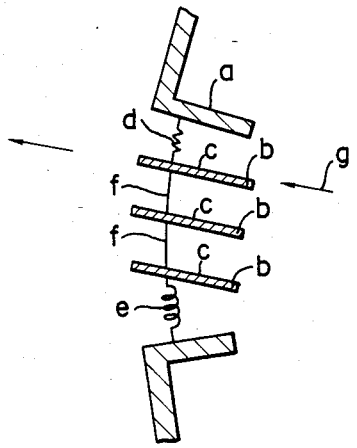
FIG. 1 is an explanatory side longitudinal sectional view of the essential parts of a conventional device for automatically adjusting the angle of louvers.
Figure 2A:
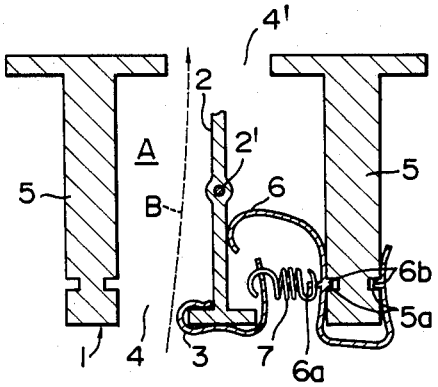
FIGS. 2.(*a*) to 6(*b*) are side sectional views of the essential parts in various embodiments of the device for automatically adjusting the angle of louvers according to the present.
Figure 2B:
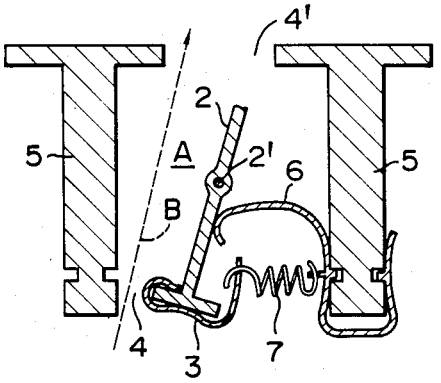
Figure 3A:
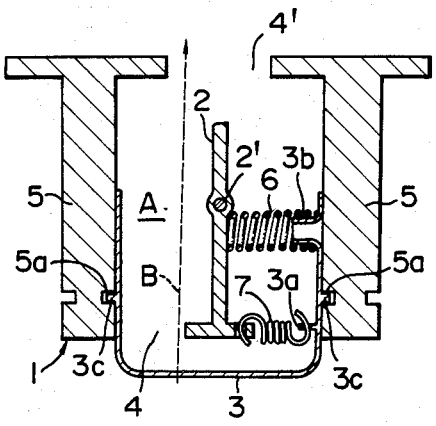
Figure 3B:
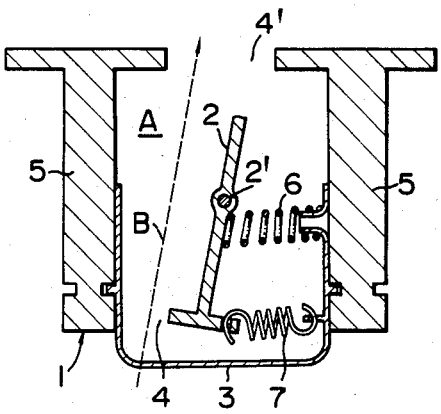

In FIG. 2(*a*), which shows the first embodiment of the invention, reference numeral 1 designates a body. A louver 2 is rotatably mounted at a pivot pin 2' arranged laterally between side walls 5 and 5 in a predetermined number of air passages A for controlling the direction of air or wind diffused in the manner known per se, and the direction of air or wind designated by an arrow B which can be variably changed from an inlet 4 toward an air diffuser 4' opened in a room by the inclining angle of the louver 2.

Fittings 3, as clip springs formed are interposed between the side walls 5 and 5 at the outside edge of the louver 2 out of a room. A bias spring 6, one end of which is interposed at the side edge of the side wall 5 at the inlet 4 out of the room, is contacted at the other end, formed substantially in U shape, with the side surface of the louver 2 below the pin 2', and the louver 2 is biased by the spring clockwise.

On the other hand, a shape memory alloy spring 7 formed in a tension coil spring is engaged at both ends thereof between an engaging piece 6*a* projected to the side of the louver 2 and the end of the fitting 3 at the part inserted into the side walls 5, thereby urging the louver 2 counterclockwise.

Reference numeral 6*b* designates a protruding piece projected oppositely to the bias spring 6, in engagement with an engaging recess 5*a* formed at the end of the side wall 5 with the edge of the side wall.

The operation of the device for automatically adjusting the angle of the louvers, thus constructed as described above, will be described.

Since the shape memory alloy spring 7 is retained in a contracted state as shown when the diffused air reaches a high temperature higher than a predetermined value such as at an ordinary temperature time or room heating time, the spring 7 attracts the louver 2 by a relatively large tension produced at the contracted time, thereby retaining the louver 2 at the neutral position where the biasing force of the spring 6 is balanced with the spring 7, i.e., in parallel with the side wall 5.

On the other hand, as shown in FIG. 2(*b*) the spring 7 is released from the compressed state at room cooling time when the diffused air flowing from the inlet 4 reaches a low temperature. The bias spring 6 overcomes the tension of the spring 7, thereby applying a force to the louver 2. Thus, the louver 2 is rotated clockwise.

Accordingly, the louver 2 becomes inclined state to diffuse the chilled air in the oblique rightward direction the invention, the fitting 3 is engaged as an invert spring formed in a channel shape between the outside end walls out of the room at both side walls 5 at the inlet 4, and is engaged at one end thereof directly with the end of the louver 2. The spring 7 is as a tension coil spring is engaged with the engaging piece 3*a* projected inwardly of the insert spring at the other end, thereby urging the louver 2 to rotate to rotate the louver 2 counterclockwise. Further, the bias spring 6, 9 compression coil, is engaged at one end with the engaging projection 3*b* of joggle-shape project toward the depth end of the insert spring, and is contacted at the other end with the side face at the lower part of the pivot pin 2' of the louver 2, thereby urging the louver 2 to rotate clockwise.

Reference numeral 3*c* designates a protruding piece projected oppositely to the outside at the fitting 3, oppositely to the insert spring piece 3*c* is in engagement with the engaging recess 5*a* formed at the end of the side wall 5, and the fittings 3 are engaged with the end of the side wall 5.

Accordingly, in this case, similarly to the first embodiment, the spring 7 is compressed by the temperature sensing capacity thereof at the room heating time, and the louver 2 is retained in the state that is balanced with the tension of the spring 6, i.e., at the neutral position in parallel with the side wall 5. The bias spring 6 overcomes the tension of the spring 7 at the room cooling time to elongate, thereby urging the louver 2. Thus, the louver 2 is rotated clockwise to inclined state, thereby diffusing cold air obliquely.

Figure 4A:
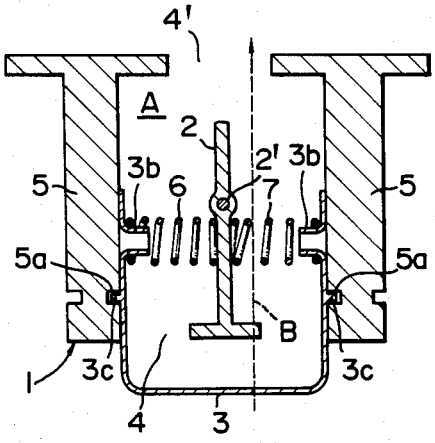
Figure 4B:
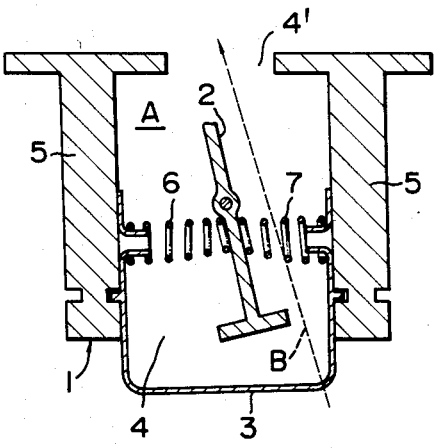

In FIGS. 4(*a*) and 4(*b*), which show a third embodiment of the invention, fitting 3 is a channel-shaped insert spring engaged between the ends out of the room at the side walls 5 at the inlet 4. The spring 7 compressed coil engaged at one end with the engaging projection 3*b* projected in joggle-shape at both depth sides of the fitting 3, and is contacted at the other end thereof with the side face of the louver 2. Thus, the louver 2 below pin 2' is urged in the clockwise direction. The spring 6 is a compression coil engaged at one end with the other engaging projection 8*b*, and is contacted at the other end with the side face of the louver 2 at the side opposite to the spring 7 thereby urging the louver 2 counterclockwise.

In this case, since the spring 7 is retained in a elongated state by heating, the spring 7 is elongated by the temperature sensing capacity itself at the room heating time. The spring 7 overcomes the tension of the spring 6, thereby retaining the louver 2 at the neutral position in parallel with the side wall 5.

On the other hand, as shown in FIG. 4(*b*), at the room cooling time, the spring 6 overcomes the tension of the spring 7, and is elongated, thereby rotating the louver 2 counterclockwise. Thus, the louver 2 is rotated counterclockwise to the inclined state, thereby diffusing chilled air obliquely.

Figure 5A:
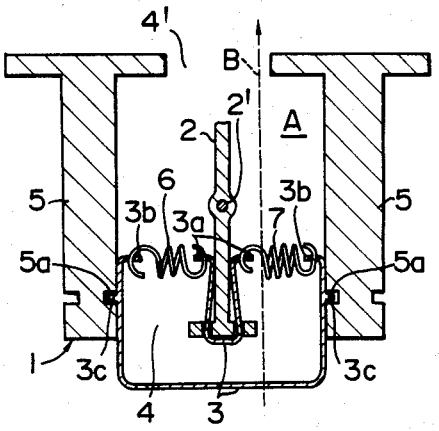
Figure 5B:
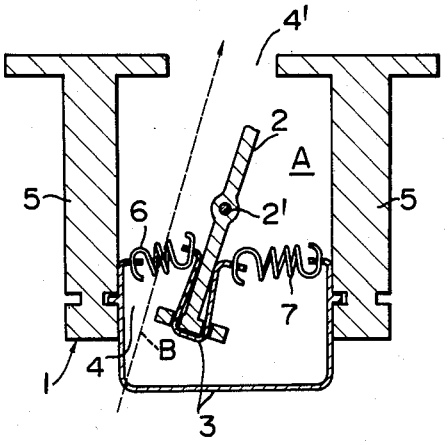

As shown in FIG. 5(*a*), which shows a fourth embodiment of the invention, fitting 3 is a channel shape insert spring are engaged at the same position as the previous second and third embodiments, but the spring 7 of tension coil state engaged at one end with the engaging projection 3*b* thus projected at both depth end of the fittings 3, is engaged with one of the engaging pieces 3*a* projected at both side ends of the fitting 3 of clip-shaped spring inserted at the other end to the end out of the room of the louver 2, the louver 2 is urged toward the clockwise direction, and the spring 6 of tension coiled state engaged at one end with the other engaging projection 3*b*, is engaged with the other engaging piece 3*a* at the other end, thereby urging the louver 2 toward the clockwise rotating direction, and in this manner, provided oppositely to the spring 7. jection 3*b*, is engaged with the other engaging piece 3*a* at the other end, thereby urging the louver 2 toward the clockwise rotating direction, and in this manner, provided oppositely to the spring 7.

Consequently, the spring 7 is in compressed state at the room heating time, and the louver 2 is retained at the position where is balanced with the tension of the spring 6, i.e., at the neutral position in parallel with the side wall 5.

On the other hand, the spring 7 is elongated by relatively small force at the room cooling time, but the louver 2 is urged clockwise by the spring 6 which has superior tension, is thus inclined, thereby diffusing the air obliquely.

Figure 6A:
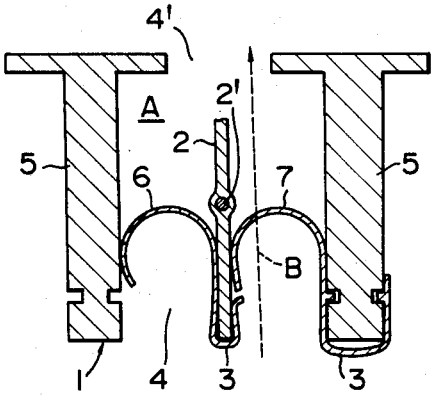
Figure 6B:
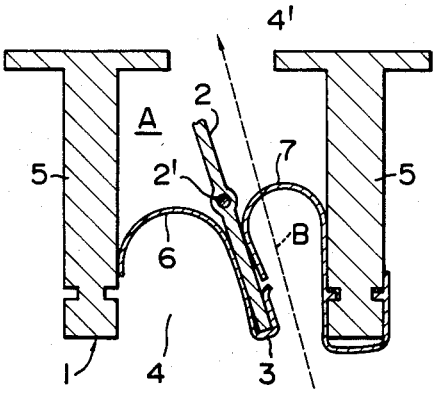

In FIG. 6(*a*), which shows fifth embodiment, the spring 7 of leaf spring state of substantially U shape inserted at one end to the edge of the side walls 5, is contacted at the other end thereof with the side surface at the lower part of the pivot pin 2' of the louver 2, thereby urging the louver 2 toward the clockwise rotating direction. Thus, the spring 6 of leaf spring state of substantially U shape inserted at one end to the side walls out of the room of the louver 2 is contacted at the other end thereof with the side walls 5, the louver 5 is urged toward the counterclockwise rotating direction, provided oppositely to the spring 7, and the fittings 3 are formed at parts of the springs 7 and 6.

Consequently, in this case, it corresponds at the coil spring of the case shown in FIG. 4 to the leaf spring, thereby operating in the same manner as that in FIG. 4.

The present invention is not limited to the embodiments described above. However, the shape memory alloy spring and the bias spring can be formed irrespective of the shape ad disposition if the louver is inclined from the neutral position of the louver at the room heating time to the room cooling time.

It is appreciated as exemplified above that, since device for automatically adjusting the angle of the louver of the present invention comprises a louver 2 pivotally secured to a body 1 in an air passage A formed between side walls 6 for altering the diffusing direction of diffused air, a shape memory alloy spring 7 for urging rotary force to the louver 3 in one direction by fittings 3 mounted at the side walls 5 of the body 1 and the louver 2, as required, and a bias spring 6 for urging rotary force reverse to the louver 3 in such a manner that the shape memory alloy spring and the bias spring are balanced in the air passage A, wherein the balanced state is collapsed by the shape memory alloy spring 7 deformed when chilled air is fed to the passage A to tiltably incline the louver 2, the louver can be automatically controlled by sensing the temperature of the diffused air by the shape memory alloy spring and the bias spring. According to the present invention, since the manual adjusting work of the louver can be eliminated, large labor can be eliminated particularly in a large building. Inasmuch as no trouble exists due to lazy work and the angle of the louver can be automatically adjusted simply and rapidly by the work of the fitting engaged with the side wall and the louvers are not necessarily coupled by fine wires as the conventional device, sufficient force can be transmitted, thereby altering the direction of the air with high reliability.

What is claimed is:

1. A device for automatically adjusting the angle of a louver comprising:

a louver pivotally secured to a body in an air passage formed between side walls for altering the diffusing direction of diffused air, a shape memory alloy spring for urging rotary force to said louver in one direction for fittings mounted at the side walls of the body and said louver, as required, and a bias spring for urging rotary force reverse to said louver in such a manner that said shape memory alloy spring and said bias spring are balanced in the air passage, wherein the balanced state is collapsed by said shape memory alloy spring deformed when chilled air is fed to the passage to tiltably incline said louver, siad louver can be automatically controlled by sensing the temperature of the diffused air by said shape memory alloy spring and said bias spring.

2. The device according to claim 1, wherein said shape memory alloy spring is used as a tension spring, and deformed in elongated state by chilled air.

3. The device according to claim 1, wherein said shape memory alloy spring is used as compression spring, and deformed in compressed state with chilled air.

4. The device according to claim 1, wherein said shape memory alloy spring and said bias spring are formed of coil springs or leaf springs.

5. The device according to claim 1, wherein one or both of said shape memory alloy spring and said bias spring comprise at part thereof fittings.

6. The device according to claim 1, wherein said fittings are formed of a clip spring elastic to be interposed between the predetermined side walls.

7. The device according to claim 1, wherein said fittings are formed of a clip spring elastic to hold one end of said louver.

8. The device according to claim 1, wherein said fittings are formed of an insert spring of channel shape elastically engageable between the inside surfaces of both side walls.

* * * * *